US006026843A

United States Patent [19]

Pozniak et al.

[11] Patent Number: 6,026,843

[45] Date of Patent: Feb. 22, 2000

[54] VALVE BOX MANIFOLD SYSTEM AND DISTRIBUTION METHOD

[75] Inventors: Peter M. Pozniak, San Jose; Benjamin R. Roberts, Los Altos, both of Calif.

[73] Assignee: The BOC Group, Inc., Murray Hill, N.J.

[21] Appl. No.: 09/199,177

[22] Filed: Nov. 24, 1998

[51] Int. Cl.[7] ..... E03B 1/00

[52] U.S. Cl. ..... 137/312; 137/386; 137/551

[58] Field of Search ..... 137/312, 313, 137/314, 386, 551, 552, 558

[56] References Cited

U.S. PATENT DOCUMENTS

| | | | |
|---|---|---|---|
| 4,989,634 | 2/1991 | Rieseck | 137/312 |
| 5,519,638 | 5/1996 | Tiao | 137/312 |
| 5,546,977 | 8/1996 | Chaney | 137/312 |
| 5,555,907 | 9/1996 | Philipp | 137/312 |

*Primary Examiner*—David J. Walczak

*Attorney, Agent, or Firm*—David M. Rosenblum; Salvatore P. Pace

[57] ABSTRACT

A valve manifold box system and method in which one or more dispense units dispense chemical to a plurality points of use. A fluid circuit is provided with valve manifolds connected in series by double walled conduits known as containment pipes. The fluid circuit is either in the form of a loop of a series of valve manifolds alternating with double walled piping so that each valve manifold is fed with chemical at opposite ends. Alternately, two dispense units could be connected to the end of an in-line type of fluid circuit. The valve manifolds are contained within valve boxes and the ends of the containment pipes are connected to the valve boxes. In this manner a leak in either the valve manifolds or the containment pipes collects within the valve boxes. Leak detectors are provided in the valve boxes and upon the sensing of a leak, the potentially leaking valve manifold as well as the associated, adjacent containment pipes feeding such valve manifold are isolated by isolation valves. In this manner, the remaining valve manifolds and hence, the points of use are above to continually be fed with chemical while the problem is investigated.

10 Claims, 3 Drawing Sheets

VALVE BOX MANIFOLD SYSTEM AND DISTRIBUTION METHOD

BACKGROUND

The present invention relates to a valve box manifold system and a method for distributing a chemical through valve manifolds to a plurality of points of use. More particularly, the present invention relates to such a system and method in which a fluid circuit is arranged such that the valve manifolds are fed with the chemical at opposite ends thereof and pairs of isolation valves, located within the fluid circuit, are positioned to selectively isolate each of the valve manifolds independently of the remaining valve manifolds.

It is often necessary to distribute chemical to a series of points of use located within an industrial facility. For instance, in a semiconductor manufacturing facility, chemicals such as photo-resist, slurries, hydrofluoric acid, hydrogen peroxide, ammonium hydroxide, and etc., are distributed to various tools used in the manufacture of the semiconductors. Typically, a dispense unit, that can be one or more pumps or pressure vessels, induces fluid flow through a fluid circuit having a series of valve manifolds that are used to connect groups of tools to the fluid circuit. The fluid circuit is provided with valve boxes to enclose the valve manifolds and double walled pipe is used throughout. As a result, any leakage from either the piping or the valve manifolds is deposited into the valve boxes which thereby serve to contain the leakage.

Typically, flow within the fluid circuit is automatically controlled by computerized control systems which act to remotely activate valves within the valve manifold upon demand of chemical from the tools. Detectors are located within the valve boxes to sense leaks and thereby cause closure of isolation valves located at opposite ends of the valve manifolds and the dispense system to shut down. A problem of such an arrangement resides in the design of the fluid circuit. The valve manifolds and valve boxes are arranged in series along the fluid circuit and the fluid circuit is fed at one end from a controlled dispense unit. Thus, in the event that a leak is sensed from one valve box, all valve manifolds and therefore all tools are shut off whether on not there is any leakage other than that at the valve box at which the leak was sensed.

As a result, tools are needlessly taken out of service producing expensive production delays. Moreover, the feeding of valve manifolds at one end leaves very little flexibility on the amount of flow that can be introduced into each tool.

As will be discussed, the present invention provides a valve manifold box system that has an improved fluid circuit to allow individual valve boxes to be taken off line for maintenance or when leaks are detected and further allows for more chemical to be introduced into each manifold.

SUMMARY OF THE INVENTION

The present invention provides a manifold box system in which one or more dispense units are provided to dispense chemical to a plurality of points of use. A fluid circuit having valve manifolds is connected in series by double walled conduits for feeding the chemical to the plurality of points of use. The fluid circuit are connected to the one or more dispense units so that each of the valve manifolds is fed with the chemical at opposite ends. Valve boxes enclose the valve manifolds and the double walled conduits are connected to the valve boxes so that leakage of the chemical from the valve manifolds and the double walled conduits is contained within the valve boxes. Leak detectors are provided for detecting the leakage within each of the valve boxes. Additionally isolation valves are positioned at the ends of the double walled conduits and at the ends of the valve manifolds so that a potentially leaking valve manifold located within a specific valve box where the leakage is detected and associated, adjacent double walled conduits, also potentially leaking, can be isolated from a remainder of the valve manifolds. A control system is responsive to the leak detectors and is configured to control the isolation valves such that upon detecting the leakage within each of the valve boxes, the isolation valves isolate the effected valve manifold and associated, adjacent double walled conduits. This allows the chemical to continued to be fed to the remainder of the valve manifolds and therefore the points of use.

In another aspect, the present invention provides a method of distributing a chemical to a plurality of points of use. In accordance with this aspect of the present invention, chemical is supplied to a fluid circuit. The fluid circuit is provided with valve manifolds connected in series by double walled conduits such that each of the valve manifolds is fed with chemical at opposite ends. The valve manifolds are enclosed by valve boxes and the double walled conduits are connected to the valve boxes so that leakage of the chemical from the valve manifolds and the double walled conduits is contained within the valve boxes. Leakage of the chemical is detected within each of the valve boxes. Upon detection of the leakage, a potentially leaking valve manifold located within a specific valve box where the leakage is detected is isolated along with associated, adjacent double walled conduits, also potentially leaking, from a remainder of the valve manifolds. This allows the chemical to be fed to the remainder of the valve manifolds and therefore the points of use.

By providing a fluid circuit that is designed so that valve manifolds are fed at opposite ends, any of the valve manifolds may be taken out of service while allowing the remaining valve manifolds to be fed with chemical. Since the valve manifolds are fed at opposite ends, more chemical can be fed to each manifold and therefore each tool then in prior art systems in which valve manifolds are fed at one end only. The valve boxes contain leakage not only from the valve manifolds, but also, the double walled piping feeding the valve manifolds. Since leakage is detected within valve boxes, the source of leakage may either be the valve manifold enclosed by the valve box or the double walled conduit connected to the valve box in which the leakage is detected. Therefore, both potentially leaking valve manifold and double walled conduit are isolated from the fluid circuit to allow the remaining valve manifolds to remain online.

BRIEF DESCRIPTION OF THE DRAWINGS

While the specification concludes with claims distinctly pointing out the subject matter that applicants regard as their invention, it is believed that the invention will be further understood when taken in connection with the accompanying drawings in which:

DETAILED DESCRIPTION OF THE INVENTION

Figure 1:
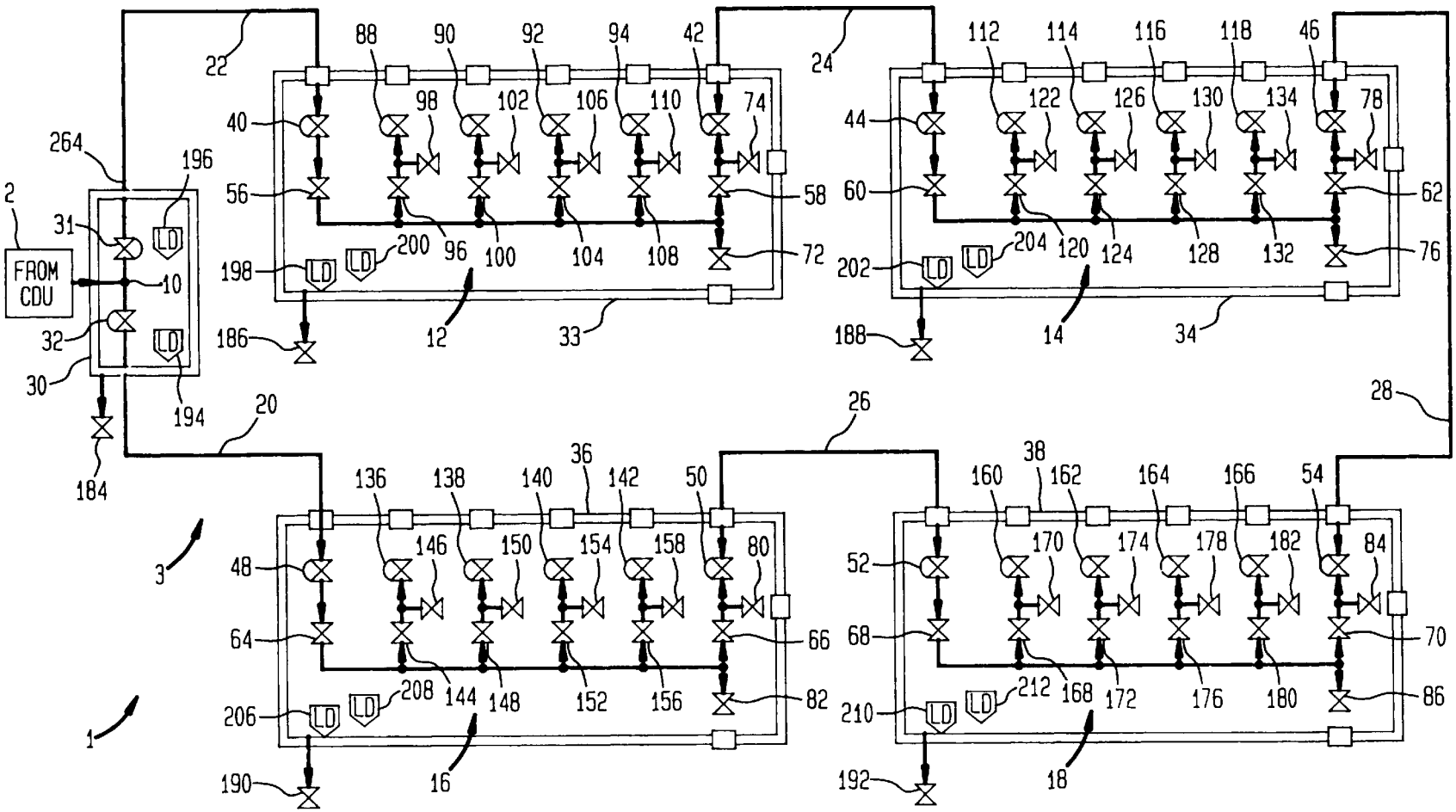
FIG. 1 is a schematic view of an apparatus for carrying out a method in accordance with the present invention.

With reference to FIG. 1, a valve manifold box system 1 in accordance with the present invention is illustrated. Valve manifold box system 1 is provided with a dispense unit 2 that feeds chemical to a fluid circuit 3. No particular dispense unit 2 is preferred and as such, dispense unit 2 can be any positive pressure device such as a pump or the type of device in which pressurized, pressure vessels alternately function to drive the chemical to points of use, e.g. semiconductor tools. An example of a dispense unit using pressure vessels is a Model D-5500 manufactured by BOC Chemical Management Systems of 3901 Burton Drive, Santa Clara, Calif., a business unit of the assignee herein.

Fluid circuit 3 includes a junction 10, valve manifolds 12, 14, 16 and 18, and containment pipes 20, 22, 24, 26, and 28. Chemical flows from junction 10, through containment pipes 20 and 22, to valve manifolds 12 and 16. The chemical then flows from valve manifolds 12 and 16 to valve manifolds 14 and 18, respectively, through containment pipes 24 and 26 and, also, a containment pipe 28.

A 'T' Box 30 is provided to contain leaks from junction 10. Similarly, valve manifold boxes 33, 34, 36 and 38 are provided to contain leaks from valve manifolds 12, 14, 16 and 18. Containment pipes 20–28 are formed from double walled conduits which also contain leaks. The outer walls of such double walled conduits are connected to valve manifold boxes 33–38 and 'T' Box 30 so that a leak in a containment pipe is contained by the outer wall. The containment pipes are installed such that natural gravity drainage leads to a location such as manifold boxes 33–38 or 'T' Box 30 where leaks may be detected.

Figure 2:
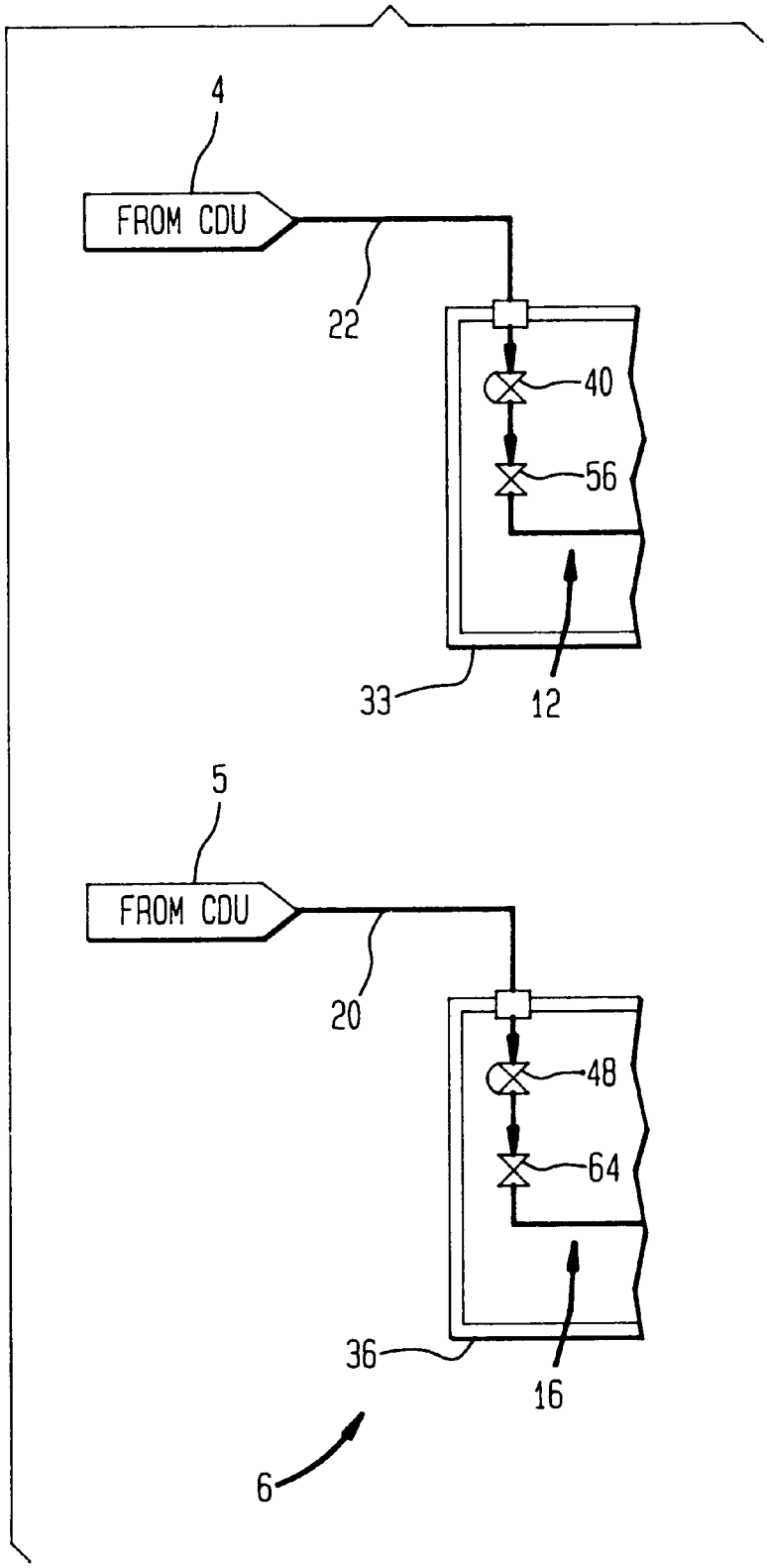
FIG. 2 is an alternative embodiment of FIG. 1.

As may be appreciated, should valve manifold 12 be taken off line, valve manifolds 14, 16 and 18 would still be on line due to the loop-like fluid circuit 3 which feeds chemical to valve manifolds 12, 14, 16 and 18 at both ends. As an alternative, with reference to FIG. 2, two dispense units 4 and 5 are provided at opposite ends of fluid a circuit 6. The portion of fluid circuit 6 not illustrated is otherwise identical to that shown in FIG. 1. As a result, since, again, liquid is being fed at both ends of fluid circuit 6, isolation of any of the valve boxes 12–18 thereof will not prevent chemical from being distributed to other of the valve boxes.

Isolation valves 31, 32, 40, 42, 44, 46, 48, 50, 52, and, 54 are located within fluid circuit 3 to selectively isolate each of valve manifolds 12, 14, 16, and 18 as well as containment pipes 20, 22, 24, 26, and 28 from fluid circuit 3. This isolation is selective and upon the sensing of a leak within valve boxes 33, 34, 36, and 38 and T-box 30. For instance, a leak detected in valve box 12 will cause isolation valves 31, 40, 42, and 44 to isolate valve manifold 12 and associated, adjacent containment pipes 22 and 24. Chemical will continue to flow to valve manifolds 16, 18, and 14 through containment pipes 20, 26, and 28. Similarly, a leak detected in valve box 34 will trigger isolation vales 42, 44, 46, and 54. Chemical will continue to be supplied to valve manifolds 12, 16, and 18 through containment pipes 20, 22, and 26. In the event that a leak is detected in valve box 36, isolation valves 32, 48, 50, and 52 will isolate valve manifold 16 and containment pipes 20 and 26. Lastly, a leak detected in valve box 38, isolation valves 50, 52, 54, and 46 will isolate valve manifold 18 and containment pipes 26 and 28.

Isolation valves 40–54, are remotely activated valves, preferably normally closed valves that are held open by a control system (to be discussed) such that any control system failure or power failure causes isolation valves 40–54 to close. Thus, when deactivated such valves assume a closed or cut-off position to cut-off the flow.

Each of valve manifolds 12, 14, 16 and 18 are also provided with manually operated isolation valves 56, 58, 60, 62, 64, 66, 68 and 70 to manually isolate valve manifolds 12, 14, 16 and 18. Additionally, manually operated drain valves 72, 74, 76, 78, 80, 82, 84 and 86 are provided for manual drain purposes. For instance, drain valves 72, 76, 82 and 86 drain valve manifolds 12, 14, 16 and 18 while drain valves 74, 78, 80 and 84 allow transfer lines 24, 26 and 28 to be drained.

Valve manifolds 12, 14, 16 and 18 are each designed to control the supply of chemical to points of use or tools. To this end, remotely activated demand valves 88, 90, 92 and 94 are provided for valve manifold 12. Pairs of manually operated isolation and drain valves 96, 98, 100, 102, 104, 106, 108 and 110 are provided for valve manifold 12. Similarly, remotely activated demand valves 112, 114, 116 and 118 are provided for valve manifold 14. Additionally, isolation and drain valves 120, 122, 124, 126, 128, 130, 132 and 134 provided for valve manifold 14. As to valve manifold 16, remotely activated demand valves 136, 138, 140 and 142 are provided. Additionally, manual isolation and drain valves 144, 146, 148, 150, 152, 154, 156 and 158 are provided. Lastly, as to valve manifold 18 remotely activated demand valves 160, 162, 164 and 166 are provided. Additionally, manually operated isolation and drain valves 168, 170, 172, 174, 176, 178, 180 and 182 are provided.

In the event of a leakage, 'T' Box 30, as well as valve boxes 33, 34, 36 and 38 may be drained by box drain valves 184, 186, 188, 190 and 192.

'T' Box 30, as well as valve boxes 33, 34, 36 and 38 are provided with at least one level detector and preferably two liquid level detectors 194, 196, 198, 200, 202, 204, 206, 208, and 210, 212. Lower leak detectors 194, 198, 202, 206 and 210 are positioned to detect leaks as they occur at low levels or at the bottom of the relevant junction or valve box. Upper leak detectors 196, 200, 204, 208 and 212 are positioned above lower leak detectors 194, 198, 202, 206 and 210, preferably approximately 6.36 mm. to detect quickly at a higher level. As a result, lower leak liquid detectors 194, 198, 202, 206 and 210 may be used to detect leaks as they occur and to activate or perhaps sound appropriate warnings. Thereafter, upper leak detectors 196, 200, 204, 208 and 212 function to automatically isolate the relevant valve boxes 33, 34, 36, and 38. In case of 'T' Box 30, a high level leak would cause shut off of controlled dispense unit 2.

There are many different possible control systems that could function with valve boxes network 1. For instance, a controller responsive to leak detectors 198, 202, 206 and 210 could function simply close off the relevant isolation valves 31, 32, 40, 42, 44, 46, 48, 50, 52, and 54 upon sensing a leak. Control of the relevant valve manifolds 12, 14, 16 and 18 and the dispense valves, for instance, dispense valves 88, 90, 92 and 94 could be separately controlled.

Figure 3:
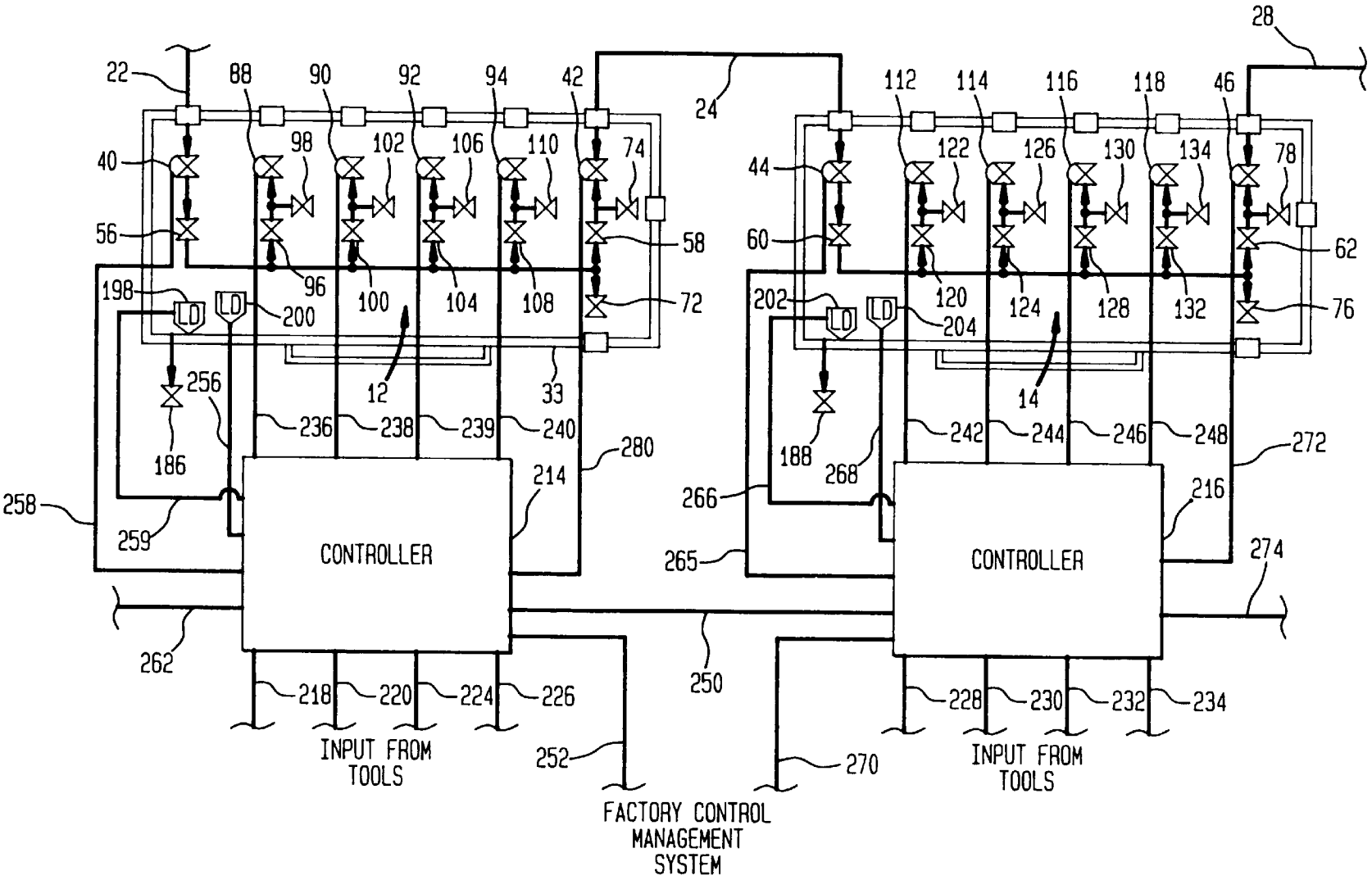
FIG. 3 is an enlarged fragmentary view of FIG. 1 illustrating a preferred control system used to operate the apparatus illustrated in either FIGS. 1 or 2.

Preferably and with specific reference to FIG. 3, each of valve boxes 12, 14, 16 and 18 are provided with a controller, for instance, a controller 214 for valve manifold 12 and controller 216 for valve manifold 14. Each of controllers 214 and 216 is preferably an integrated circuit containing an interface module manufactured by LONWORKS™ available from Eshelon located at 4015 Miranda Avenue, Palo Alto, Calif., 94394.

Controllers 214 and 216 are electrically connected by connectors 218, 220, 224 and 226 (for controller 214) and connectors 228, 230, 232, 234 (for controller 216) to semiconductor processing tools or other points of use, not illustrated. Upon a demand of chemical from the relevant tool, electrical connectors 236, 238, 239, 240, 242, 244, 246 and 248 act as electrical signal pathways for appropriately opening and closing remotely activated dispense valves, 88, 90, 92, 94 of valve manifold 12 or remotely activated dispense valves 112, 114, 116, 118 for valve manifold 14.

Controllers 214 and 216 also interface and produce handshake signals that travel between controllers 214 and 216 by a connector 250. In the event that a leak is sensed by, for instance, leak detector 198, a signal is sent by controller 214 along a cable 252 to the factory control management system. Additionally, other statuses may be displayed concerning the tools. For instance, impulses transmitted by conductors 218, 220, 224 and 226 may be provided to indicate tools dispensing, and when chemical will be required by a high and low sensing. In the event that a leak is detected, by for instance leak detector 198, an alarm is sounded in the factory control management system. This alarm will allow personnel to diagnose the problem instead of the common practice of simply shutting off tools. If a leak is sensed by leak detector 200, however, a signal is sent by lines 256, 258 and 260' to activate isolation valves 40 and 42. At the same time, adjacent isolation valve 44 is activated to assume a closed position by controller 216 by a signal sent through cable 250. Controller 214 is also connected to a controller that would be associated with 'T' Box 30 by a cable 262 to cut off the other directly adjacent isolation valve 31. Alarms are sent by cable 252 to the factory control management system.

Level detectors 202 and 204 are also connected to controller 16 by connectors 266 and 268, A connector 270 is provided to connected controller 16 to the factory control management system to function in the same manner as connector 252. Moreover, isolation valves 44 and 46 are controlled by impulses traveling along line 265 and line 272. A cable 274 is connected to a similar controller associated with valve manifold 18.

Controllers 214 and 216 can also function with the control management system to limit the number of active tools. For instance, the number of tools receiving chemical vs. the amount of chemical available for dispensing is continually monitored. If many tools are receiving chemical, other tools that will require chemical are placed in an inactive mode. It is possible to track times for filling requests to tools that are calculated based upon on historical data. In the event that a tools takes longer than usual to fill, an alarm will be sounded and the relevant dispense valve can be cut off to bring the tool off line. Other signals can be programmed.

While the present invention has been described with reference to a preferred embodiment, as will occur to those skilled in the art, numerous changes, additions and omissions may be made without departing from the spirit and scope of the present invention.

We claim:

1. A valve manifold box system comprising:

at least one dispense unit to dispense chemical to a plurality points of use;

a fluid circuit having valve manifolds connected in series by double walled conduits for feeding said chemical to said plurality of points of use;

the fluid circuit connected to said at least one dispense unit so that each of said valve manifolds is fed with said chemical at opposite ends;

valve boxes enclosing said valve manifolds and said double walled conduits connected to said valve boxes so that leakage of said chemical from said valve manifolds and said double walled conduits is contained within said valve boxes;

leak detectors for detecting said leakage within each of said valve boxes;

isolation valves positioned at the ends of said double walled conduits and at the ends of said valve manifolds so that a potentially leaking valve manifold located within a specific valve box where said leakage is detected and associated, adjacent double walled conduits, also potentially leaking, can be isolated from a remainder of said valve manifolds; and a control system responsive to said leak detectors and configured to control said isolation valves such that upon detecting said leakage within each of said valve boxes, said isolation valves isolate said effected valve manifold and associated, adjacent double walled conduits to allow said chemical to continued to be fed to said remainder of said valve manifolds and therefore said points of use.

2. The valve manifold box system of claim 1, wherein each of said manifold boxes has two of said leak detectors set at two different heights and said control system is further configured to produce an alarm when a leak is detected by the lower of the two leak detectors and to control said isolation valves to isolate said effected valve manifold and associated, adjacent double walled conduits when a leak is detected by the higher of the two leak detectors.

3. The valve manifold box system of claim 2, wherein said fluid circuit is arranged in a loop and one of said at least one dispense units is connected to said loop.

4. The valve manifold box system of claim 2, wherein said fluid circuit has two of said at least one dispense united connected at opposite ends to said fluid circuit.

5. The valve manifold box system of claim 1, wherein said fluid circuit is arranged in a loop and one of said at least one dispense units is connected to said loop.

6. The valve manifold box system of claim 1, wherein said fluid circuit has two of said at least one dispense units connected at opposite ends to said fluid circuit.

7. A method of distributing a chemical to a plurality of points of use, said method comprising:

supplying said chemical into a fluid circuit having valve manifolds connected in series by double walled conduits such that each of said valve manifolds is fed with chemical at opposite ends;

the valve manifolds being enclosed by valve boxes and said double walled conduits being connected to said valve boxes so that leakage of said chemical from said valve manifolds and said double walled conduits is contained within said valve boxes;

detecting said leakage of said chemical within said valve boxes; and upon detection of said leakage, isolating a potentially leaking valve manifold located within a specific valve box where said leakage is detected and associated, adjacent double walled conduits, also potentially leaking, from a remainder of said valve manifolds to allow said chemical to be fed to said remainder of said valve manifolds and therefore said points of use.

8. The method of claim 7 wherein:

the fluid circuit has a loop-like configuration and a junction positioned within said fluid circuit; and said chemical is supplied with said chemical passing through said junction.

9. The method of claim 7, wherein the fluid circuit has opposite ends and said chemical is fed to said opposite ends of said fluid circuit.

10. The method of claim 7 wherein:

lower and higher liquid levels of said leakage is also detected within said valve boxes;

upon detection of said lower liquid level of said leakage an alarm is activated; and upon detection of said higher liquid level of said leakage said effected valve manifold and associated, adjacent double walled conduits are isolated.

* * * * *